US007843414B2

(12) United States Patent
Hsu et al.

(10) Patent No.: US 7,843,414 B2
(45) Date of Patent: Nov. 30, 2010

(54) LIQUID CRYSTAL DISPLAY DRIVER AND METHOD THEREOF

(75) Inventors: Ying-Hao Hsu, Tainan County (TW); Ming-Chia Shih, Tainan County (TW); Wang-Yang Li, Tainan County (TW)

(73) Assignee: Chimei Innolux Corporation, Miao-Li County (TW)

( * ) Notice: Subject to any disclaimer, the term of this patent is extended or adjusted under 35 U.S.C. 154(b) by 1001 days.

(21) Appl. No.: 10/887,088

(22) Filed: Jul. 9, 2004

(65) Prior Publication Data

US 2005/0057473 A1 Mar. 17, 2005

(30) Foreign Application Priority Data

Aug. 27, 2003 (TW) ..... 92123674 A

(51) Int. Cl.
*G09G 3/36* (2006.01)

(52) U.S. Cl. ..... 345/89; 345/690

(58) Field of Classification Search ..... 345/55, 345/84, 87–104, 690, 694; 348/674; 382/167; 349/106, 141, 164, 144
See application file for complete search history.

(56) References Cited

U.S. PATENT DOCUMENTS

| | | | | |
|---|---|---|---|---|
| 5,717,474 | A | 2/1998 | Sarma | |
| 5,847,688 | A | 12/1998 | Ohi et al. | |
| 6,256,010 | B1 | 7/2001 | Chen et al. | |
| 6,600,470 | B1 * | 7/2003 | Tsuda | 345/89 |
| 6,952,193 | B2 * | 10/2005 | Abe et al. | 345/87 |
| 7,176,876 | B2 * | 2/2007 | Kabuto et al. | 345/89 |
| 2001/0015774 | A1 * | 8/2001 | Endo et al. | 348/807 |
| 2001/0038371 | A1 * | 11/2001 | Yoshinaga et al. | 345/87 |
| 2002/0014958 | A1 | 2/2002 | Inoue et al. | |
| 2002/0015110 | A1 * | 2/2002 | Brown Elliott | 348/589 |
| 2002/0024481 | A1 * | 2/2002 | Kawabe et al. | 345/87 |
| 2002/0149598 | A1 | 10/2002 | Greier et al. | |
| 2002/0163490 | A1 * | 11/2002 | Nose | 345/89 |
| 2003/0006952 | A1 | 1/2003 | Hong | |
| 2003/0058211 | A1 * | 3/2003 | Kim et al. | 345/89 |
| 2003/0128179 | A1 | 7/2003 | Credelle | |
| 2003/0146893 | A1 | 8/2003 | Sawabe | |

(Continued)

FOREIGN PATENT DOCUMENTS

JP 60 037526 A 2/1985

(Continued)

OTHER PUBLICATIONS

JP 2000-152260 A; English Translation.*

(Continued)

*Primary Examiner*—Amr Awad
*Assistant Examiner*—Michael Pervan
(74) *Attorney, Agent, or Firm*—Thomas, Kayden, Horstemeyer & Risley, LLP

(57) ABSTRACT

A system comprises a liquid crystal display viewable from front and side view points, and comprising a plurality of pixels having corresponding original luminance values, a plurality of data lines in the display, a plurality of data drivers for driving the data lines, and an adjusted gray scale generator for adjusting gray scales of the pixels and outputting adjusted gray scales to the data drivers for driving the data lines.

17 Claims, 11 Drawing Sheets

U.S. PATENT DOCUMENTS

| | | | |
|---|---|---|---|
| 2003/0160915 | A1 | 8/2003 | Liu |
| 2003/0197668 | A1 | 10/2003 | Song et al. |
| 2004/0001167 | A1 | 1/2004 | Takeuchi et al. |
| 2004/0061711 | A1 | 4/2004 | Kurumisawa et al. |

FOREIGN PATENT DOCUMENTS

| | | | | |
|---|---|---|---|---|
| JP | H03-181988 | A | | 7/1991 |
| JP | H05-068221 | A | | 3/1993 |
| JP | 2000152260 | A | * | 5/2000 |
| JP | 2001-343636 | A | | 12/2001 |

OTHER PUBLICATIONS

Keneko S et al. "Wide-Viewing-Angle Improvements for AMLCDS" SID International Symposium- Digest of Technical Papers. Seattle, May 16-21, 1993. vol. 24, Part 1, May 16, 1993. pp. 265-268.
European Search Report for EP 04019705.5.
Annex to the European Search Report for EP 04019705.5.
English translation of abstract of JP 60 037526 A.
English translation of abstract of JP H05-068221.
English translation of abstract of JP 2001-343636.
English translation of abstract of JP H03-181988.

* cited by examiner

| | | | | | |
|---|---|---|---|---|---|
| R11 | G11 | B11 (128) | R12 | G12 | B12 (128) |
| R21 | G21 | B21 (128) | R22 | G22 | B22 (128) |
| R31 | G31 | B31 (128) | R32 | G32 | B32 (128) |
| R41 | G41 | B41 (128) | R42 | G42 | B42 (128) |

Image

Fig.6A (Prior Art)

| | | | | | |
|---|---|---|---|---|---|
| R11 | G11 | B11 (128) | R12 | G12 | B12 (128) |
| R21 | G21 | B21 (128) | R22 | G22 | B22 (128) |
| R31 | G31 | B31 (128) | R32 | G32 | B32 (128) |
| R41 | G41 | B41 (128) | R42 | G42 | B42 (128) |

Image

Fig.6B (Prior Art)

| | | | | | |
|---|---|---|---|---|---|
| R11 | G11 | B11 (174) | R12 | G12 | B12 (0) |
| R21 | G21 | B21 (0) | R22 | G22 | B22 (174) |
| R31 | G31 | B31 (174) | R32 | G32 | B32 (0) |
| R41 | G41 | B41 (0) | R42 | G42 | B42 (174) |

Fig.7

| | | | | | | | | |
|---|---|---|---|---|---|---|---|---|
| G | R | B | B | R | G | G | R | B |
| B | R | G | G | R | B | B | R | G |
| R | R | B | B | R | G | G | R | B |
| B | R | G | G | R | B | B | R | G |

LIQUID CRYSTAL DISPLAY DRIVER AND METHOD THEREOF

BACKGROUND OF THE INVENTION

1. Field of the Invention

The present invention generally relates to a monitor display and, more particularly, to a display method and device for compensating color shifting in direct and side image viewing.

2. Description of the Related Art

FIG. 1 is a diagram that illustrates an example of a conventional display system having a liquid crystal display ("LCD") panel 100. LCD panel 100 comprises 1024 red, green and blue ("RGB") data lines, namely, 1024×3 data lines, and 768 scan lines. The data lines and scan lines are respectively driven by a plurality of data drivers 102 and scan drivers 104. A controller 106 outputs a data control signal ("Cntl_D") to data drivers 102, which accordingly receive and process the pixel data ("PD") from controller 106. After processing the received pixel data, each of data drivers 102 outputs corresponding voltages for driving 384 data lines in LCD panel 100. Scan drivers 104, at the control of a scan control signal ("Cntl_S") from controller 106, respectively output scan signals and control 256 scan lines. A pixel is then defined at each intersection of a data line and a scan line. After scanning all of the scan lines, all of the pixels have been driven for completing the display of an image frame.

There are differences in luminance with respect to LCD panel 100 as it is viewed from its front and sides, since retardation values differ for light entering into the liquid crystal material at different angles. That is, different viewing angles result in differences in transmittance and retardation values. For RGB light being mixed together as LCD panel 100 is viewed directly and from the sides, color shifting may result as each of the red, green and blue light is subject to frontal and side views.

In U.S. Pat. No. 5,711,474, displaying images at different viewing angles with respect to an end user includes the division of a single pixel into a plurality of areas having different characteristics. Since the different areas in a pixel correspond to different viewing angles, and the pixel elements cannot be adjusted after the display is made. Consequently, the display quality and effect may be adversely affected.

In U.S. Pat. No. 5,847,688, original signals are separately input and processed at two time frames and two pixels using different drivers according to gamma curves correspond to two different viewing angles. However, there may be display flicker during transition between two time frames of image display. Moreover, the composite image may have only one half of a pixel directed to displaying an image at a specific viewing angle, which could not properly provide image viewing at multiple angles. Display resolution may be adversely affected as a result.

In US2002/0149598, 2×2 or more subpixels are used for displaying images. Original images are adjusted according to calculations of proportionalities of luminance in the pixels for image display. However, multiple pixels are needed for displaying images.

There is thus a general need in the art for a system and method overcoming at least the aforementioned shortcomings in the art. A particular need exists in the art for a system and method overcoming disadvantages with respect to color shifting when an LCD panel is viewed directly and from the sides.

BRIEF SUMMARY OF THE INVENTION

Accordingly, one embodiment of the present invention is directed to a liquid crystal display system and method that obviate one or more of the problems due to limitations and disadvantages of the related art.

To achieve these and other advantages, and in accordance with the purpose of the present invention as embodied and broadly described, there is provided a system comprising a liquid crystal display comprising a plurality of pixels having corresponding original luminance values, a plurality of data lines in the display, a plurality of data drivers for driving the data lines, and an adjusted gray scale generator for adjusting gray scales of the pixels and outputting adjusted gray scales to the pixels, to result in adjusted luminance values of the pixels.

Embodiments consistent with the present invention can include a method comprising the steps of driving a plurality of data lines in the display, measuring original luminance values corresponding to a plurality of pixels in the display, adjusting gray scales of a plurality of pixels in the display, and adjusting the original luminance values of the pixels according to the adjusted gray scales, wherein the original luminance values and the adjusted luminance values of the pixels when the display is viewed from a front view point are generally the same.

Further embodiments consistent with the present invention can include a method comprising the steps of generating an original signal corresponding to a first intensity value for a pixel element in a display at a first frequency, converting the original signal into two correction signals corresponding to a second intensity value and a third intensity value respectively at double the first frequency, wherein the first intensity value is between the second and the third intensity value, and sequentially outputting the two correction signals into the pixel element.

Additional embodiments consistent with the present invention can include a display device for generating luminance for a pixel element comprising a circuit for generating an original signal corresponding to a first intensity value for said pixel element at a first frequency, a converter for converting said original signal into two correction signals corresponding to a second intensity value and a third intensity value respectively at double the first frequency, wherein the first intensity value is between the second and the third intensity value, and a memory for storing and outputting the two correction signals.

In one aspect, one embodiment of the present invention provides a display device comprising a plurality of pixels in rows and columns having a first color, a second color and a third color, wherein two adjacent pixels in one of the rows have the same color. In another aspect, the present invention provides a display device comprising a plurality of pixels in rows and columns having a first color, a second color and a third color, wherein two adjacent pixels in one of the rows have the same color.

Additional features and advantages of the present invention will be set forth in part in the detailed description which follows, and in part will be obvious from the detailed description, or may be learned by practice of the present invention. The features and advantages of the present invention will be realized and attained by means of the elements and combinations particularly pointed out in the appended claims.

It is to be understood that both the foregoing general description and the following detailed description are exemplary and explanatory only and are not restrictive of the present invention, as claimed.

The accompanying drawings, which are incorporated in and constitute a part of this specification, illustrate several embodiments of the present invention and together with the description, serve to explain the principles of the present invention.

BRIEF DESCRIPTION OF THE DRAWINGS

FIGS. 6A and 6B are diagrams showing examples of two adjacent images in a conventional display system;

FIG. 7 is a diagram showing an example of an image being displayed in a display system consistent with the present invention;

DESCRIPTION OF THE EMBODIMENTS

Reference will now be made in detail to present embodiments of the invention, examples of which are illustrated in the accompanying drawings. Wherever possible, the same reference numbers will be used throughout the drawings to refer to the same or like parts.

When the original red, green and blue colors have different grayscales in an LCD panel, the respective levels of color shifting will be different. Consistent with the present invention, in order to reduce color shifting, the color displayed by a pixel in an image frame is divided into two colors having less color shifting being displayed in two subframes, or two colors having less color shifting being displayed in two adjacent pixels.

Figure 2:
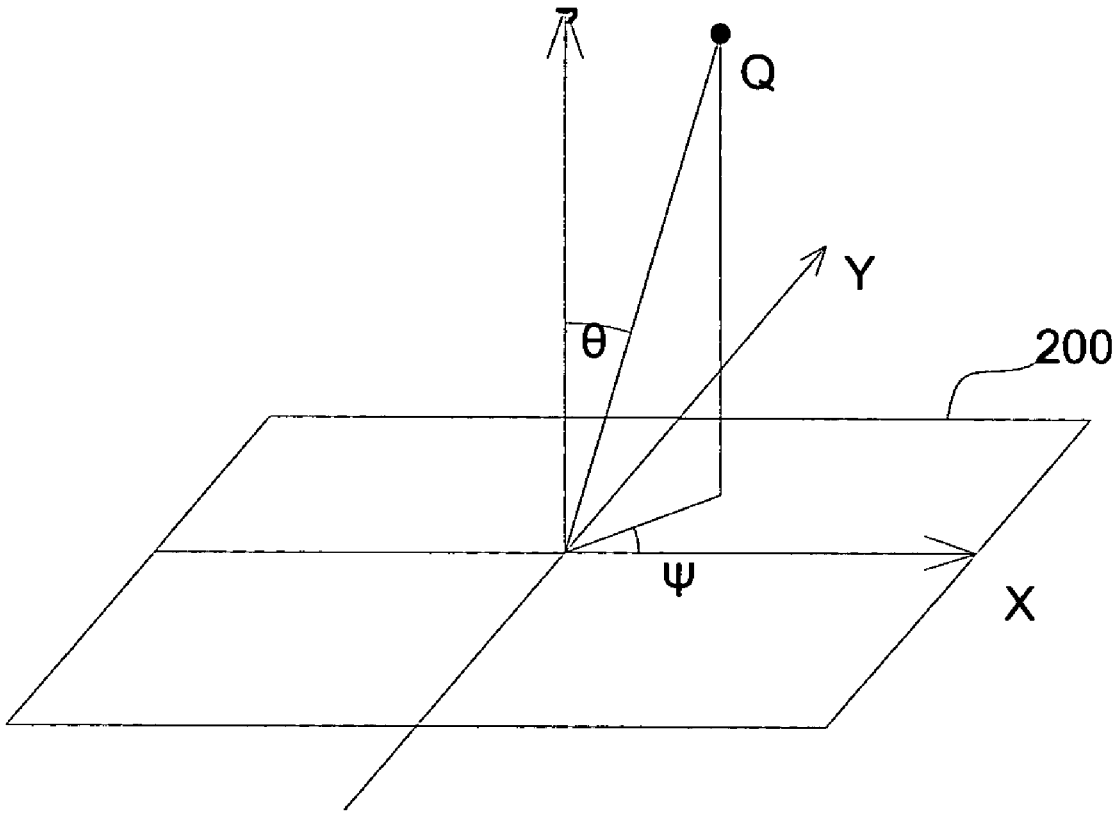
FIG. 2 is a diagram that illustrates a coordinate system representing an end user viewing an LCD at a viewing position.
Figure 3A:
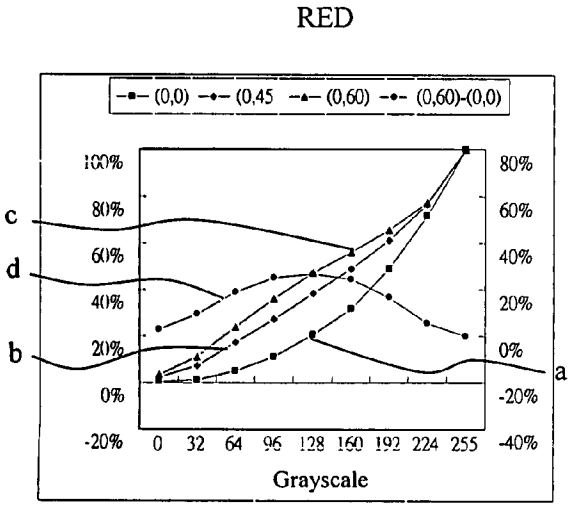
FIGS. 3A, 3B and 3C are diagrams that illustrate a relationship between normalized luminance and gray scales of different viewing angles for red, green and blue light, respectively.
Figure 3B:
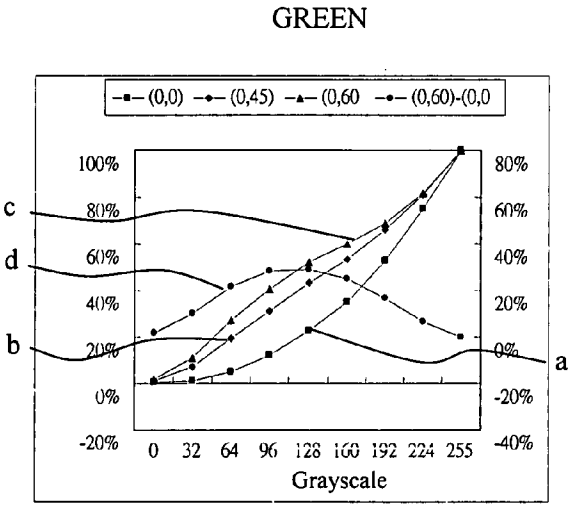
Figure 3C:
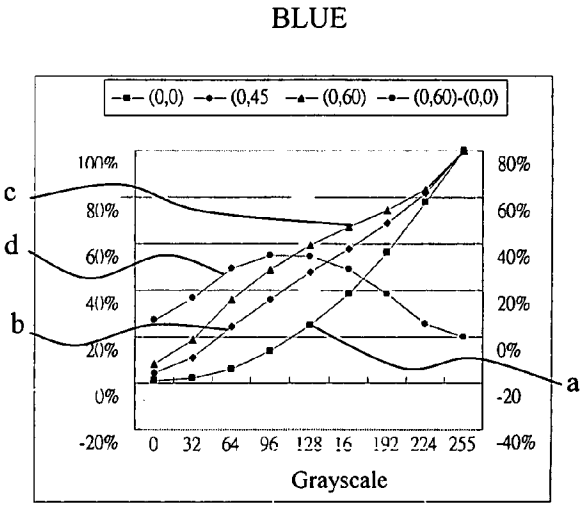

FIG. 2 is a diagram that illustrates a coordinate system representing an end user viewing an LCD 200 at a viewing point Q. FIGS. 3A, 3B and 3C are diagrams respectively illustrating the relationship between normalized transmittance (or luminance) and gray scales for different viewing angles for red, green and blue light, where gray scales for the pixels range from 0 to 255. The normalized transmittance (or luminance) value for a gray scale is the luminance of a front view corresponding to that gray scale divided by the maximum luminance for the front view, e.g., a gray scale value of 255 for a normally black display. The normalized transmittance (luminance) value for a gray scale of a side view is the luminance of the side view corresponding to that gray scale divided by the maximum luminance for the side view. In general, the front view of the maximum luminance is different from the side view of the maximum luminance. In view of the color shifting, it is necessary to compare the respective normalized luminance (or transmittance) values of any two viewing angles. Referring to FIG. 2, an angle $\theta$ is defined between the line from the center of LCD 200 to the viewing point Q and the Z axis, and an angle $\phi$ is defined between the line projected from point Q onto LCD 200 and the X axis. FIGS. 3A, 3B and 3C illustrate the respective relationships between normalized transmittance (luminance) and gray scales at angle $(\phi, \theta)=(0°, 0°)$, $(0°, 45°)$ and $(0°, 60°)$. When $(\phi, \theta)=(0°, 0°)$, LCD 200 is being directly viewed from the front. When $(\phi, \theta)=(0°, 45°)$ or $(0°, 60°)$, LCD 200 is being viewed from the side at 45-and 60-degree angles, respectively. Line a in FIGS. 3A, 3B and 3C represents the front view ($\phi=0°$, $\theta=0°$) of the relationship between the red, green, blue normalized luminance, respectively, and gray scales. Line b in FIGS. 3A, 3B and 3C represents the side view ($\phi=0°$, $\theta=45°$) of the relationship between the red, green, blue normalized luminance, respectively, and gray scales. Line c in FIGS. 3A, 3B and 3C represents the side view ($\phi=0°$, $\theta=60°$) of the relationship between the red, green, blue normalized luminance, respectively, and gray scales. Line d in FIGS. 3A, 3B and 3C represents the difference between the front view ($\phi=0°$, $\theta=0°$) and the side view ($\phi=0°$, $\theta=60°$) of the red, green and blue normalized luminance, respectively, in the relationship between such difference and gray scales.

As shown in FIGS. 3A, 3B and 3C, frontal and side viewing of light having different colors at the same gray scale will have different normalized luminance values, resulting in color shifting. The difference between normalized luminance values for the front and side views is small (i.e., close to 0%) when the gray scale is close to 0 or 255. Consistent with the present invention, for an original gray scale at a value of 128, for example, an adjusted gray scale is determined so that the difference between normalized luminance values for the side and front views and normalized luminance values for the original gray scale of 128 is small. Moreover, an end user, when viewing the LCD panel, will still enjoy generally the same brightness, notwithstanding the adjusted gray scales for minimizing color shifting with respect to the side and front views.

Figure 4:
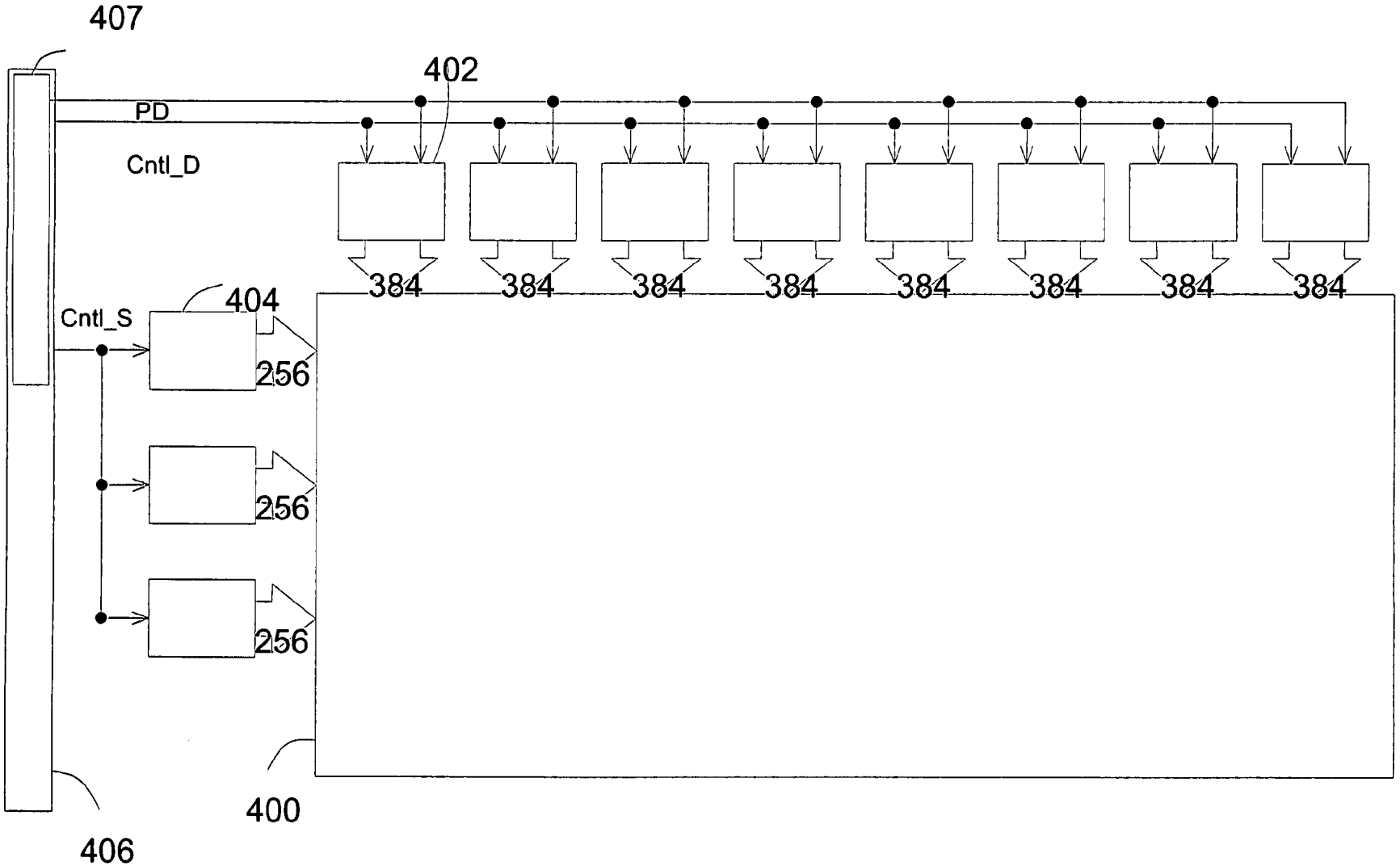
FIG. 4 is a diagram that illustrates an example of a LCD display system with color shifting compensation for front and side viewing according to one embodiment of the present invention.
Figure 9:
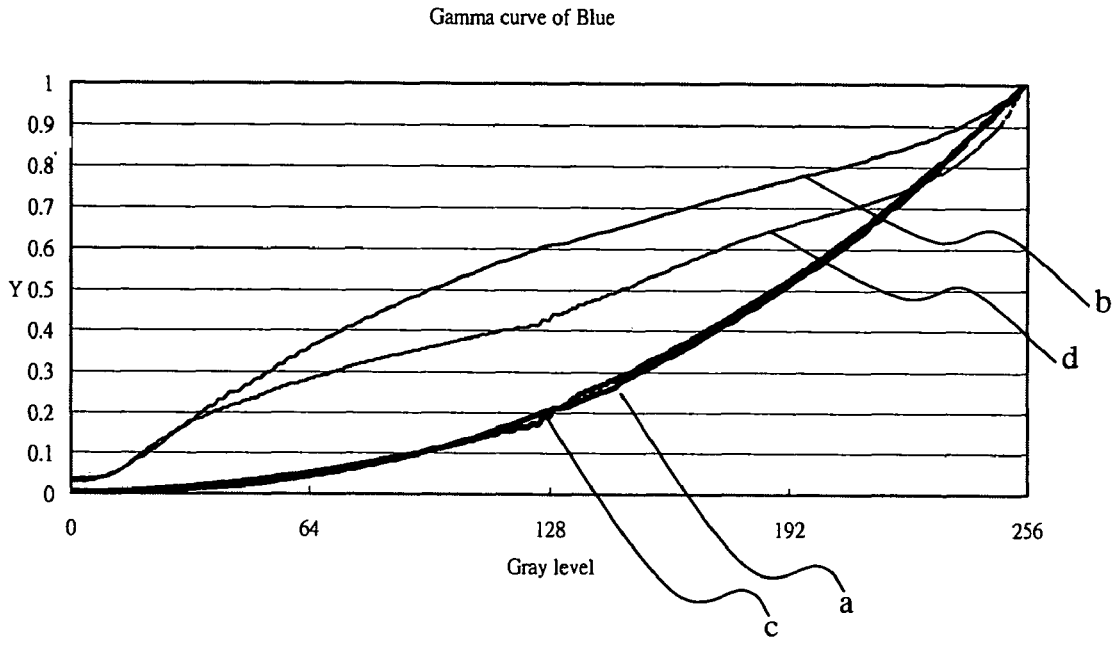
FIG. 9 is a graphical representation of the display results of the relationship between blue normalized luminance and gray scales (Gamma Curve) at different viewing angles in one embodiment of a normally black LCD.

FIG. 4 illustrates an embodiment consistent with the present invention that employs adjusting the gray scale in the time domain and includes an LCD 400 display system with color shifting compensation for front and side viewing. LCD 400 comprises a plurality of pixels (a pixel being represented by, e.g., P(i, j), i and j being positive integers), data drivers 402, scan drivers 404, and a controller 406. Controller 406 further comprises an adjusted gray scale generator 407. One image frame is displayed in the LCD for each frame period. A frame period is divided into n subframes $SFP_1$ through $SFP_n$, n being a positive integer. The original gray scales of pixels P(i, j) are GR0(i, j). A lookup table stored in adjusted gray scale generator 407 records all original gray scales (GR0) and at least one corresponding adjusted gray scale GR1 through GRn. Line d in FIGS. 3A, 3B and 3C illustrates that FIG. 3C (the blue color) has the greatest difference between the front view and side view of normalized luminance. In view of this, the blue color may be adjusted first. Table 1 below shows an example of such a lookup table for the original and adjusted gray scales for blue color in a specific embodiment of a normally black, 20.1-inch, liquid crystal display ("LCD"). The "Gray" represents the original gray scales for blue color, and "LUT 1" and "LUT 2" represent the adjusted gray scales for blue color GR1 and GR2, respectively. The display results in such a normally black LCD for the blue color of the relationship between normalized luminance of blue and gray scales (Gamma Curve), which are shown in graphical form in FIG. 9. Line a of FIG. 9 represents the front view ($\phi=0°$, $\theta=0°$) of the relationship between the original normalized luminance and gray scales. Line b of FIG. 9 represents the 60° side view ($\phi=0°$, $\theta=60°$) of the relationship between original normalized luminance of blue and gray scales. Line c of FIG. 9 represents the front view ($\phi=0°$, $\theta=0°$) of the relationship between adjusted normalized luminance of blue (using adjusted gray scales such as those in Table 1) and gray scales. Line d of FIG. 9 represents the 60° side view ($\phi=0°$, $\theta=60°$) of the relationship between adjusted normalized luminance of blue (using adjusted gray scales such as those in Table 1 below) and gray scales.

TABLE 1

| Gray | LUT 1 | LUT 2 |
|---|---|---|
| 0 | 0 | 0 |
| 1 | 5 | 0 |
| 2 | 5 | 0 |
| 3 | 5 | 0 |
| 4 | 6 | 0 |
| 5 | 33 | 0 |
| 6 | 34 | 0 |
| 7 | 54 | 0 |
| 8 | 66 | 0 |
| 9 | 84 | 0 |
| 10 | 94 | 0 |
| 11 | 112 | 0 |
| 12 | 122 | 0 |
| 13 | 133 | 0 |
| 14 | 141 | 0 |
| 15 | 147 | 0 |
| 16 | 152 | 0 |
| 17 | 156 | 0 |
| 18 | 159 | 0 |
| 19 | 162 | 0 |
| 20 | 164 | 0 |
| 21 | 166 | 0 |
| 22 | 168 | 0 |
| 23 | 169 | 0 |
| 24 | 171 | 0 |
| 25 | 172 | 0 |
| 26 | 173 | 0 |
| 27 | 175 | 0 |
| 28 | 176 | 0 |
| 29 | 177 | 0 |
| 30 | 178 | 0 |
| 31 | 179 | 0 |
| 32 | 180 | 0 |
| 33 | 181 | 0 |
| 34 | 182 | 0 |
| 35 | 182 | 0 |
| 36 | 183 | 0 |
| 37 | 184 | 0 |
| 38 | 185 | 0 |
| 39 | 186 | 0 |
| 40 | 186 | 0 |
| 41 | 187 | 0 |
| 42 | 187 | 0 |
| 43 | 188 | 0 |

TABLE 1-continued

| Gray | LUT 1 | LUT 2 |
|---|---|---|
| 44 | 189 | 0 |
| 45 | 189 | 0 |
| 46 | 190 | 0 |
| 47 | 191 | 0 |
| 48 | 191 | 0 |
| 49 | 192 | 0 |
| 50 | 192 | 0 |
| 51 | 193 | 0 |
| 52 | 193 | 0 |
| 53 | 194 | 0 |
| 54 | 194 | 0 |
| 55 | 195 | 0 |
| 56 | 195 | 0 |
| 57 | 196 | 0 |
| 58 | 196 | 0 |
| 59 | 197 | 0 |
| 60 | 197 | 0 |
| 61 | 197 | 0 |
| 62 | 198 | 0 |
| 63 | 198 | 0 |
| 64 | 199 | 0 |
| 65 | 199 | 0 |
| 66 | 200 | 0 |
| 67 | 200 | 0 |
| 68 | 201 | 0 |
| 69 | 201 | 0 |
| 70 | 202 | 0 |
| 71 | 202 | 0 |
| 72 | 203 | 0 |
| 73 | 203 | 0 |
| 74 | 204 | 0 |
| 75 | 204 | 0 |
| 76 | 205 | 0 |
| 77 | 205 | 0 |
| 78 | 206 | 0 |
| 79 | 206 | 0 |
| 80 | 207 | 0 |
| 81 | 207 | 0 |
| 82 | 208 | 0 |
| 83 | 208 | 0 |
| 84 | 209 | 0 |
| 85 | 209 | 0 |
| 86 | 210 | 0 |
| 87 | 210 | 0 |
| 88 | 211 | 0 |
| 89 | 211 | 0 |
| 90 | 212 | 0 |
| 91 | 212 | 0 |
| 92 | 213 | 0 |
| 93 | 213 | 0 |
| 94 | 214 | 0 |
| 95 | 214 | 0 |
| 96 | 215 | 0 |
| 97 | 215 | 0 |
| 98 | 216 | 0 |
| 99 | 216 | 0 |
| 100 | 217 | 0 |
| 101 | 217 | 0 |
| 102 | 218 | 0 |
| 103 | 218 | 0 |
| 104 | 219 | 0 |
| 105 | 219 | 0 |
| 106 | 220 | 0 |
| 107 | 220 | 0 |
| 108 | 221 | 0 |
| 109 | 221 | 0 |
| 110 | 222 | 0 |
| 111 | 222 | 0 |
| 112 | 223 | 0 |
| 113 | 223 | 0 |
| 114 | 223 | 0 |
| 115 | 224 | 0 |
| 116 | 224 | 0 |
| 117 | 224 | 0 |
| 118 | 224 | 0 |
| 119 | 225 | 0 |
| 120 | 225 | 0 |

TABLE 1-continued

| Gray | LUT 1 | LUT 2 |
|---|---|---|
| 121 | 225 | 0 |
| 122 | 225 | 0 |
| 123 | 226 | 0 |
| 124 | 226 | 0 |
| 125 | 226 | 0 |
| 126 | 225 | 2 |
| 127 | 225 | 2 |
| 128 | 225 | 2 |
| 129 | 225 | 3 |
| 130 | 225 | 3 |
| 131 | 225 | 3 |
| 132 | 225 | 4 |
| 133 | 225 | 4 |
| 134 | 225 | 5 |
| 135 | 225 | 5 |
| 136 | 225 | 6 |
| 137 | 225 | 6 |
| 138 | 225 | 7 |
| 139 | 225 | 7 |
| 140 | 225 | 8 |
| 141 | 225 | 8 |
| 142 | 225 | 9 |
| 143 | 225 | 9 |
| 144 | 225 | 10 |
| 145 | 225 | 10 |
| 146 | 225 | 11 |
| 147 | 225 | 12 |
| 148 | 225 | 13 |
| 149 | 225 | 13 |
| 150 | 225 | 14 |
| 151 | 225 | 15 |
| 152 | 225 | 16 |
| 153 | 225 | 17 |
| 154 | 225 | 18 |
| 155 | 225 | 19 |
| 156 | 225 | 20 |
| 157 | 225 | 21 |
| 158 | 225 | 22 |
| 159 | 225 | 23 |
| 160 | 225 | 24 |
| 161 | 225 | 26 |
| 162 | 225 | 27 |
| 163 | 225 | 28 |
| 164 | 225 | 29 |
| 165 | 225 | 30 |
| 166 | 225 | 32 |
| 167 | 225 | 33 |
| 168 | 225 | 34 |
| 169 | 225 | 36 |
| 170 | 225 | 37 |
| 171 | 225 | 39 |
| 172 | 225 | 40 |
| 173 | 225 | 42 |
| 174 | 225 | 43 |
| 175 | 225 | 45 |
| 176 | 225 | 47 |
| 177 | 225 | 48 |
| 178 | 225 | 50 |
| 179 | 225 | 52 |
| 180 | 225 | 53 |
| 181 | 225 | 55 |
| 182 | 225 | 57 |
| 183 | 225 | 58 |
| 184 | 225 | 60 |
| 185 | 225 | 62 |
| 186 | 225 | 65 |
| 187 | 225 | 70 |
| 188 | 225 | 74 |
| 189 | 225 | 79 |
| 190 | 225 | 83 |
| 191 | 225 | 88 |
| 192 | 225 | 93 |
| 193 | 225 | 97 |
| 194 | 225 | 102 |
| 195 | 225 | 107 |
| 196 | 225 | 112 |
| 197 | 225 | 116 |

TABLE 1-continued

| Gray | LUT 1 | LUT 2 |
|---|---|---|
| 198 | 225 | 121 |
| 199 | 225 | 126 |
| 200 | 225 | 131 |
| 201 | 225 | 135 |
| 202 | 225 | 140 |
| 203 | 225 | 144 |
| 204 | 225 | 148 |
| 205 | 225 | 152 |
| 206 | 225 | 156 |
| 207 | 225 | 160 |
| 208 | 225 | 163 |
| 209 | 225 | 167 |
| 210 | 225 | 170 |
| 211 | 225 | 174 |
| 212 | 225 | 177 |
| 213 | 225 | 180 |
| 214 | 225 | 183 |
| 215 | 225 | 187 |
| 216 | 225 | 190 |
| 217 | 225 | 193 |
| 218 | 225 | 195 |
| 219 | 225 | 198 |
| 220 | 225 | 200 |
| 221 | 225 | 203 |
| 222 | 225 | 205 |
| 223 | 225 | 208 |
| 224 | 225 | 211 |
| 225 | 225 | 214 |
| 226 | 225 | 216 |
| 227 | 225 | 219 |
| 228 | 225 | 221 |
| 229 | 225 | 224 |
| 230 | 225 | 225 |
| 231 | 226 | 226 |
| 232 | 227 | 227 |
| 233 | 227 | 227 |
| 234 | 228 | 228 |
| 235 | 229 | 229 |
| 236 | 230 | 230 |
| 237 | 231 | 231 |
| 238 | 232 | 232 |
| 239 | 233 | 233 |
| 240 | 234 | 234 |
| 241 | 235 | 235 |
| 242 | 236 | 236 |
| 243 | 237 | 237 |
| 244 | 239 | 239 |
| 245 | 240 | 240 |
| 246 | 241 | 241 |
| 247 | 242 | 242 |
| 248 | 243 | 243 |
| 249 | 244 | 244 |
| 250 | 246 | 246 |
| 251 | 247 | 247 |
| 252 | 249 | 249 |
| 253 | 251 | 251 |
| 254 | 253 | 253 |
| 255 | 255 | 255 |

From such a lookup table, generator 407 (shown in FIG. 4) generates n adjusted gray scales from original gray scales GR0(i, j) for pixel P(i, j), including GR1 (i, j), GR2(i, j) . . . GRn(i, j). The n adjusted gray scales are input into corresponding data drivers 402 sequentially and accordingly displayed in n subframes.

Referring back to FIG. 4, for n subframe periods, data drivers 402 drive pixels P(i, j) with n drive voltages corresponding to n adjusted gray scales. Original gray scales GR0 (i, j) correspond to the original normalized luminance of front views ("L0(i, j)") and side views ("L0'(i, j)"). For each subframe period, adjusted normalized luminance for the front views and side views is determined from corresponding adjusted gray scales. For the adjusted gray scales GR1 through GRn stored in the lookup table corresponding to original gray scales GR0, the sum of the absolute value of the difference between the adjusted normalized luminance values for the front and side views should be less than the sum of the absolute value of the difference between the original normalized luminance values for the front and side views. Color shifting between the front and side views is advantageously minimized as a result. Moreover, all of the adjusted normalized luminance values for the front views are generally the same as the original normalized luminance values for the front views, thereby assuring similarity between the original frame and the adjusted frame.

Figure 5A:
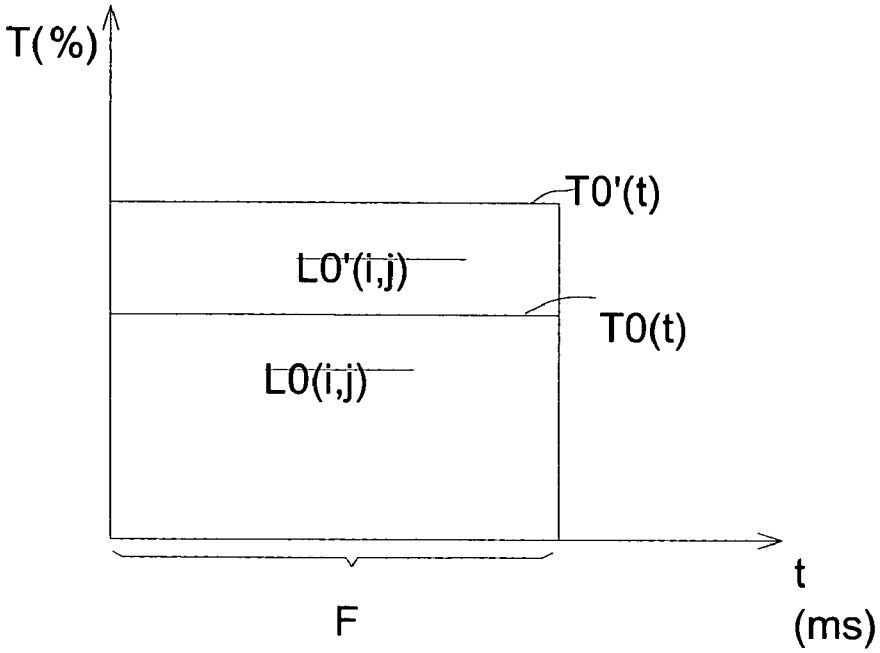
Fig.5A (Prior Art)
FIGS. 5A and 5B are graphical views comparing luminance values of pixels in a conventional display system and a system according to the present invention.
Figure 5B:
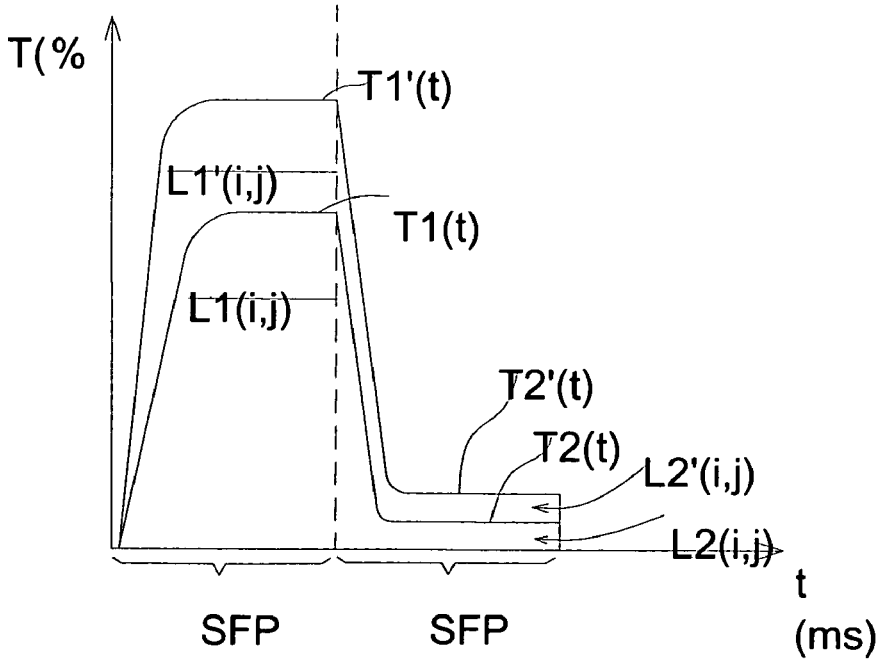

FIGS. 5A and 5B are graphical views comparing normalized transmittance values of pixels in a conventional display system and a system consistent with the present invention, respectively. FIG. 5A is a graphical view showing normalized transmittance values T(%) for pixels P(i, j) corresponding to original gray scales GR0 as the pixels are voltage driven, versus time, in a conventional display system. FIG. 5B is a graphical view showing the normalized transmittance values T(%) for pixels P(i, j) corresponding to adjusted gray scales GR1 through GRn as the pixels are voltage driven, versus time. A frame period ("FP") is divided into two subframe periods, namely SFP1 and SFP2. For SFP1, respective adjusted normalized luminance values L1(i, j) and L1'(i, j) for the front and side views, respectively, are determined from adjusted gray scales GR1(i, j). For SFP2, respective adjusted normalized luminance values L2(i, j) and L2'(i, j) for the front and side views, respectively, are determined from adjusted gray scales GR2(i, j). For SFP1 and SFP2, $|L1(i, j)-L1'(i, j)|+|L2(i, j)-L2'(i, j)|<|L0(i, j)-L0'(i, j)|$.

Referring to FIG. 5A, drive voltages corresponding to original gray scales GR0(i, j) are used to drive pixels P(i, j) for a frame period in a conventional display system, where the functions of normalized transmittance values T0(t) and T0'(t) respectively correspond to front and side views of pixels P(i, j). Original normalized luminance values L0(i, j) for the front view correspond to the integrated value of T0(t) within frame period FP. Similarly, original normalized luminance values L0'(i, j) for the side view correspond to the integrated value of T0'(t) within frame period FP.

Referring to FIG. 5B, for subframe period SFP1, drive voltages corresponding to adjusted gray scales GR1(i, j) are used to drive pixels P(i, j), where T1(t) and T1'(t) respectively represent the time function of normalized transmittance values for front and side views of pixels P(i, j). For SFP2, drive voltages corresponding to adjusted gray scales GR2(i, j) are used to drive pixels P(i, j) where T2(t) and T2'(t) respectively represent the time function of normalized transmittance values for front and side views of pixels P(i, j). Adjusted normalized luminance values L1(i, j) for the front views correspond to the integrated value of T1(t) within subframe period SFP1 when drive voltages corresponding to adjusted gray scales GR1(i, j) are used to drive pixels P(i, j). Adjusted normalized luminance values L1'(i, j) for the side view correspond to the integrated value of T1'(t) within subframe period SFP1 when drive voltages corresponding to adjusted gray scales GR1(i, j) are used to drive pixels P(i, j). Adjusted normalized luminance values L2(i, j) for the front view correspond to the integrated value of T2(t) within subframe period SFP2 when drive voltages corresponding to adjusted gray scales GR2(i, j) are used to drive pixels P(i, j). Adjusted normalized luminance values L2'(i, j) for the side view correspond to the integrated value of T2'(t) within subframe period SFP2 when drive voltages corresponding to adjusted gray scales GR2(i, j) are used to drive pixels P(i, j).

For adjusted gray scales GR1(i, j) and GR2(i,j), $|L1(i, j)-L1'(i, j)|+|L2(i, j)-L2'(i, j)|<|L0(i, j)-L0'(i, j)|$. When an end userviews pixels P(i, j), the cumulative effect of differences between normalized luminance values for the front and side views corresponding to gray scales GR1(i, j) in SFP1 and normalized luminance values for the front and side views corresponding to gray scales GR2(i, j) in SFP2 is less, compared with the difference between normalized luminance values for the front and side views corresponding to gray scales GR0(i, j) in a frame period FP in a conventional system. Color shifting for pixels P(i, j) is thus advantageously minimized consistent with the present invention.

In addition, consistent with the present invention, adjusted gray scales GR1(i, j) and GR2(i, j) corresponding to the sum of normalized luminance values L1(i, j) and L2(i, j) for the front views are generally the same as normalized original luminance values L0(i, j) for the front views. When an end user views pixels P(i, j), the luminance for the pixels is attributed to the cumulative effect of luminance values for adjusted gray scales GR1(i, j) and GR2(i, j) respectively corresponding to subframe periods SFP1 and SFP2, which approximates the luminance of original gray scales GR0 corresponding to pixels within a frame period FP in a conventional display system.

Furthermore, in one aspect, each of SFP1 and SFP2 is advantageously one half of frame period FP. In a further aspect, original gray scales GR0(i, j) are advantageously between adjusted gray scales GR1(i, j) and GR2(i, j). In another aspect, adjusted gray scales GR1(i, j) are greater than GR2(i, j). For example, when the original gray scale for blue pixels P(i, j) is 128, adjusted gray scale GR1(i, j) can be 190, where GR2(i, j) is 0, assuming SFP1=SFP2=(½) FP. In view of FIG. 5B, once original gray scale 128 is adjusted to gray scale 190 and 0 respectively corresponding to SFP1 and SFP2, the absolute value of the difference between normalized luminance values for the front and side (at 60 degrees) views will be less than that of original gray scale 128. Thus, consistent with the present invention, differences in pixel luminance for the front and side views are advantageously less than those in a conventional display system, thereby minimizing the effect of color shifting.

The absolute value of the difference of the normalized luminance value between the front and side (from 60 degrees) views for gray scale 0 is very small, which is well suited to serve as GR2(i, j). Image display is properly ascertained by dynamically and continuously adjusting GR1(i, j) and GR2(i, j) within a frame period FP to achieve optimal luminance. For example, when the original gray scale is 128, GR1(i, j) and GR2(i, j) can be (190, 0) or (0, 190), respectively.

According to an embodiment of the lookup table, original gray scales GR0(i, j) are fixed and corresponding normalized luminance values L0(i, j) are measured. In one aspect, the original frame period is divided into two equivalent subframe periods. Since the change between front and side views for gray scale 0 is the smallest, and for reducing response time for driving liquid crystal elements, gray scale 0 is selected to be GR2(i, j). Since the characteristics for driving liquid crystal elements are not rectangular waves, adjustment is needed for GR1(i, j) and GR2(i, j) so that the sum of normalized luminance values L1(i, j) and L2(i, j) is generally the same as original normalized luminance values L0(i, j). The cumulative effect of the differences between normalized luminance values for the front and side views corresponding to gray scales GR1(i, j) in SFP1 and normalized luminance values for the front and side views corresponding to gray scales GR2(i, j) in SFP2 is less, compared with the difference between normalized luminance values for the front and side views corresponding to gray scales GR0(i, j) in a frame period FP in a conventional system. GR1(i, j) and GR2(i, j) accordingly obtained for all gray scales are then used to form the lookup table.

A further embodiment consistent with the present invention is implemented in the space domain for changing the gray scales. Color shifting with respect to the front and side views is compensated by displaying an image within a single frame period ("FP"). In one aspect, the display system includes a liquid crystal display ("LCD") further comprising a display panel, a plurality of data drivers, a plurality of scan drivers and a controller. The panel further comprises a plurality of pixels, and the controller further includes an adjusted gray scale generator. For two pixels Pa and Pb, the adjusted gray scale generator generates adjusted gray scales GRa1 and GRb1 for original gray scales GRa0 and GRb0 for the pixels Pa and Pb, respectively. GRa0 and GRb0 respectively correspond to the original normalized luminance values for the front and side views (La and La'), and the original normalized luminance values for the front and side views (Lb and Lb').

Within the frame period FP, data drivers respectively drive the two pixels Pa and Pb with first and second drive voltages corresponding to adjusted gray scales GRa1 and GRb1. As pixel Pa is driven with the first drive voltage, Pa includes adjusted normalized luminance values Lc and Lc' for the front and side views, respectively. As pixel Pb is driven with the second drive voltage, Pb includes adjusted normalized luminance values Ld and Ld' for the front and side views, respectively. For pixels Pa and Pb, $|Lc-Lc'|+|Ld-Ld'|<|La-La'|+|Lb-Lb'|$.

In one aspect, the adjusted gray scale generator comprises a lookup table, from which adjusted gray scales GRa1 and GRb1 are generated. The lookup table records original gray scales GRa0 and GRb0, and corresponding adjusted gray scales GRa1 and GRb1.

In one aspect, pixels Pa and Pb are adjacent to each other and have the same color. Original gray scales GRa0 and GRb0 are between adjusted gray scales GRa1 and GRb1. Adjusted normalized luminance values for the front and side views (Lc and Ld, respectively) are generally the same as the sum of original normalized luminance values for the front and side views La and Lb.

FIGS. 6A and 6B are diagrams showing examples of two adjacent images M and M+1 in a conventional display system. FIG. 7 is a diagram showing an example of an image being displayed in a display system consistent with the present invention. Red, green and blue pixels are respectively represented by letters R, G and B. Original gray scales for adjacent pixels are generally close, e.g., blue pixels B11 and B21 having the same original gray scale at 128. Adjusted gray scales GRa1 at 174 and GRb1 at 0 are selected when blue pixels B11 and B21 have the same original gray scale 128. Thus, as shown in FIG. 7, gray scales for blue pixels B11 and B21 are 174 and 0, respectively, consistent with the present invention. For the next image being displayed, gray scales for B11 and B21 are 0 and 174, respectively. According to the embodiment shown in FIG. 7, pixels having different colors have relatively large gaps therebetween.

Consistent with the present invention, pixel matrices can have a number of different pixel arrangements. In one aspect, one embodiment of the present invention provides a display device comprising a plurality of pixels in rows and columns having a first color, a second color and a third color, wherein two adjacent pixels in one of the rows have the same color. In another aspect, the present invention provides a display device comprising a plurality of pixels in rows and columns having a first color, a second color and a third color, wherein two adjacent pixels in one of the rows have the same color.

Figures 8A, 8B:
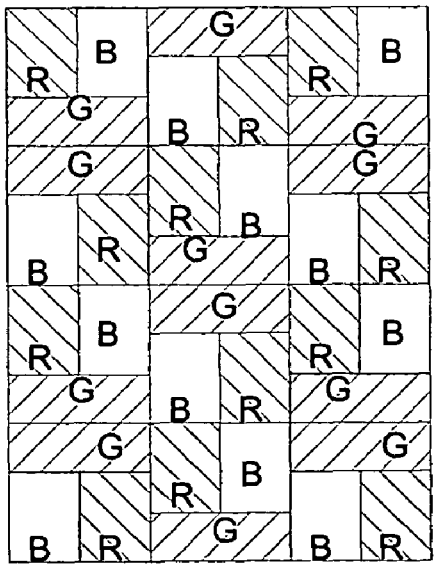
FIGS. 8A and 8B are diagrams showing examples of pixel matrices having a number of different pixel arrangements consistent with the present invention.

FIGS. 8A and 8B are diagrams showing examples of pixel matrices having a number of different pixel arrangements. In addition to the coloring pixel arrangement shown in FIG. 7, two adjacent pixels in a row can also be the same color, as shown in FIG. 8A, such as a row of pixels GRBBRGGRB. There can be different arrangements of mixed order for every row, such as the order of the two adjacent rows GRBBRGGRB and BRGGRBBRG. For this particular embodiment, pixels G and B have the same adjacent pixel, so the gap between the two single-color pixels (G and B) is advantageously reduced. Moreover, the order of the pixels can be arranged so that two pixels are diagonally adjacent one another in an LCD panel, as shown in FIG. 8B. Referring to FIG. 8B, a pair of red pixels R and a pair of blue pixels B are horizontally arranged, whereas a pair of green pixels G is located above or below the pair of red pixels R and the pair of blue pixels B. Green pixels G is further located in a mixed manner below red pixels R and blue pixels B, so pixels of the same color are adjacent along the diagonal lines in the LCD panel. Gaps between the single-color pixels are advantageously reduced as a result, as shown in FIGS. 8A and 8B, which is conducive to optimizing the resolution for the pixels.

Figure 10:
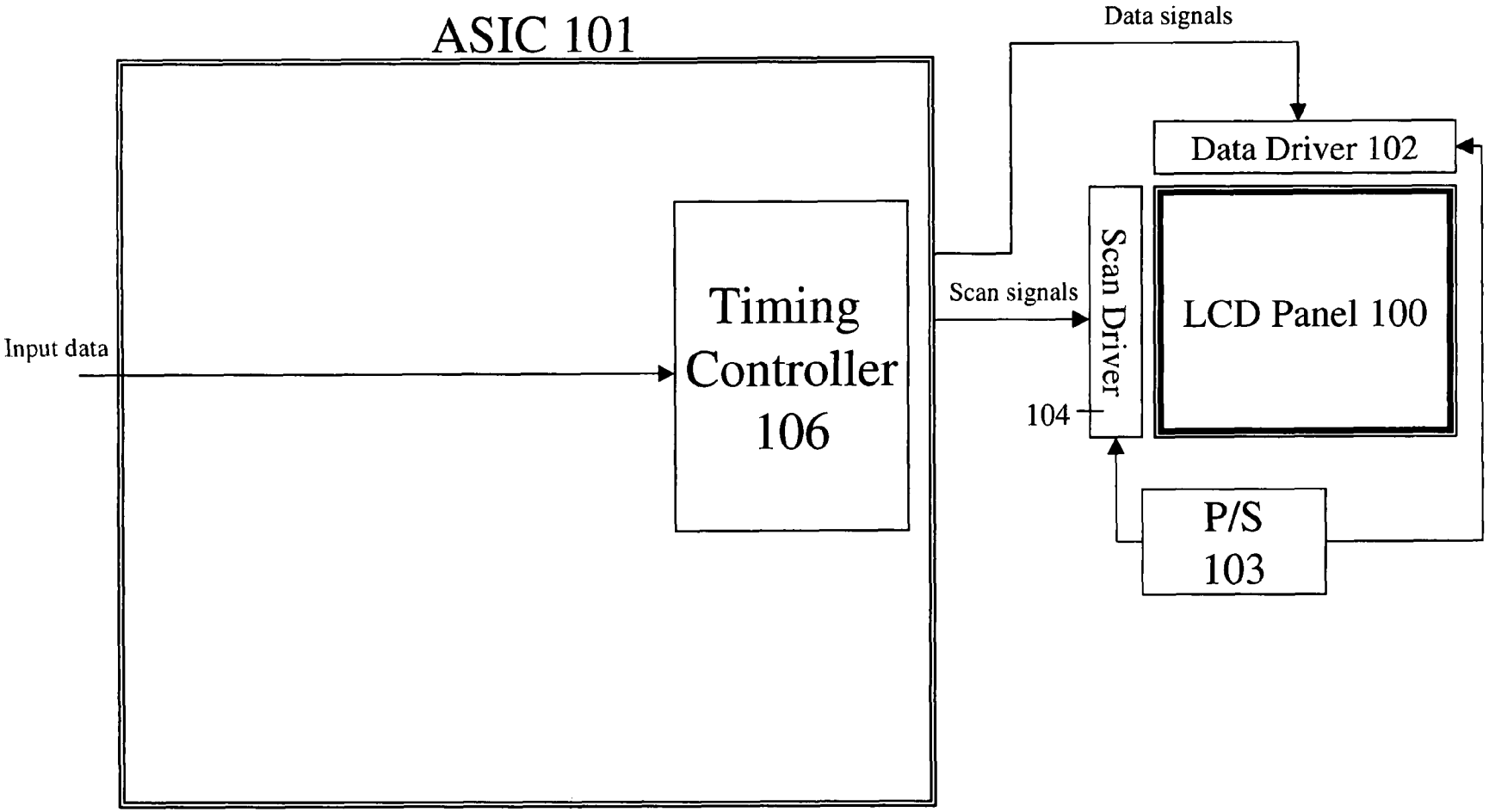
FIG. 10 (Prior Art)
FIG. 10 is a diagram that illustrates an example of a conventional LCD display system having an application specific integrated circuit ("ASIC")
Figure 11:
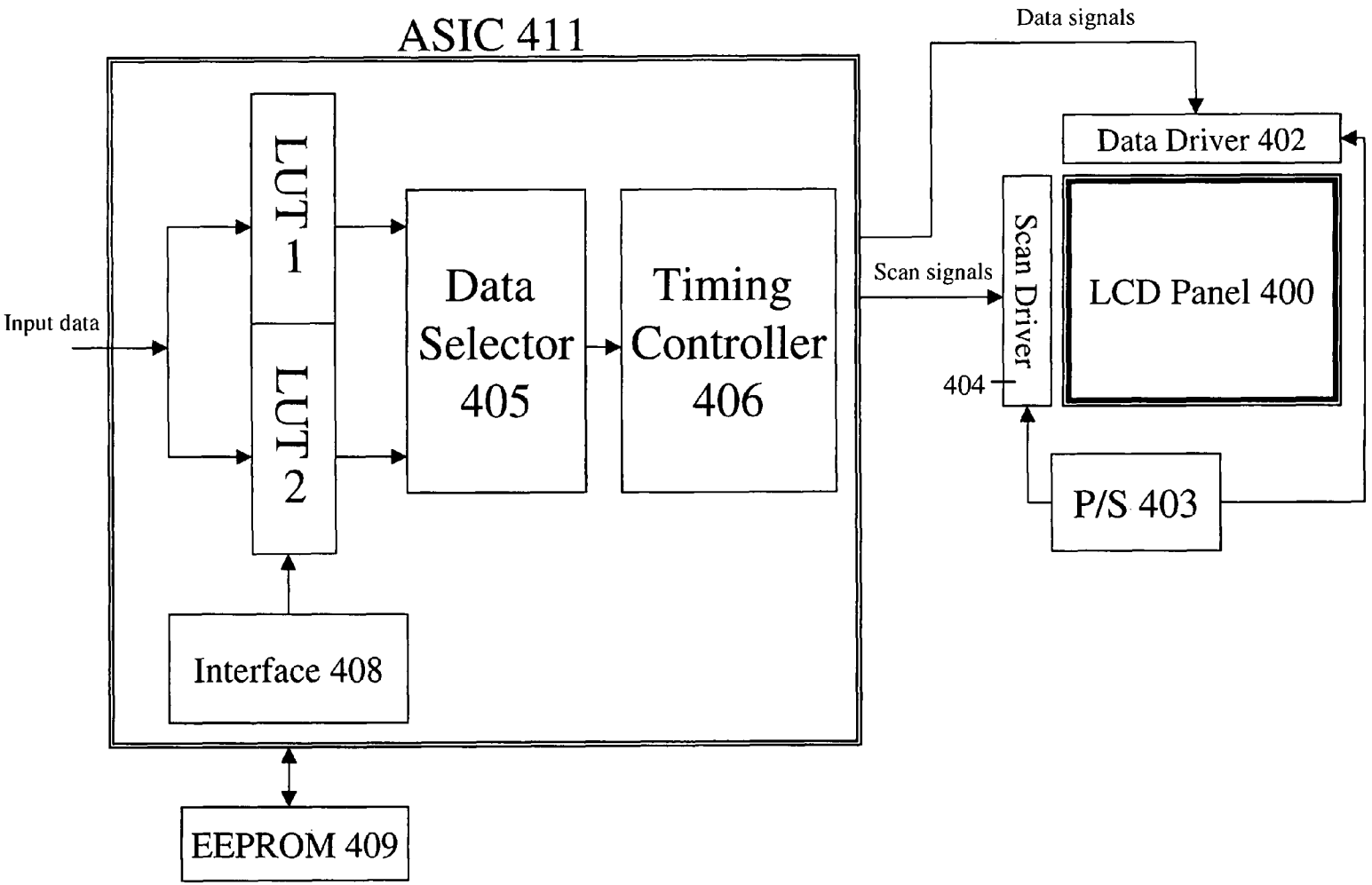
FIG. 11 is a diagram that illustrates an example of an LCD display system having an application specific integrated circuit ("ASIC") with color shifting compensation for front and side viewing according to one embodiment of the present invention.

FIGS. 10 and 11 are diagrams illustrating examples of an LCD display system having an application specific integrated circuit ("ASIC"), respectively without color shifting compensation (FIG. 10), and with color shifting compensation (FIG. 11) for front and side viewing according to one embodiment of the present invention.

Figure 1:
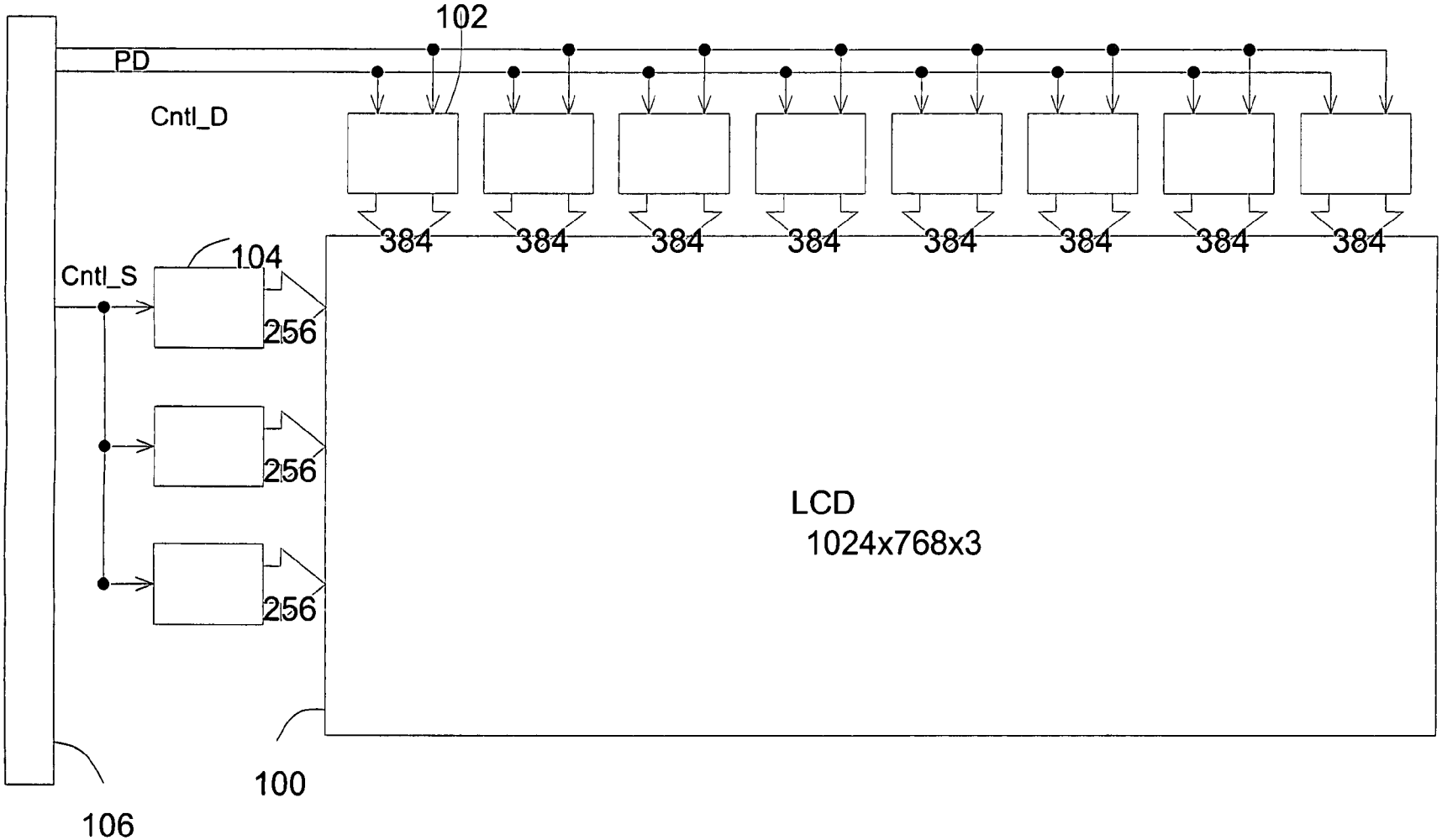
FIG.1 (Prior Art)
FIG. 1 is a diagram that illustrates an example of a conventional display system having a liquid crystal display ("LCD") panel.

Referring to FIG. 10, an LCD panel 100 comprises 1024 red, green and blue ("RGB") data lines, namely, 1024×3 data lines, and 768 scan lines, similar to the LCD panel shown in FIG. 1. The data lines and scan lines are respectively driven by a plurality of data drivers 102 and scan drivers 104. A power supply 103 supplies power to data drivers 102 and scan drivers 104. An ASIC 101 includes timing controller 106 that outputs a data control signal to data drivers 102, which accordingly receive and process the pixel data from controller 106. After processing the received pixel data, each of data drivers 102 outputs corresponding voltages for driving 384 data lines in LCD panel 100. Scan drivers 104, at the control of a scan control signal from controller 106, respectively output scan signals and control 256 scan lines. After scanning all of the scan lines, all of the pixels have been driven for completing the display of an image frame.

FIG. 11 is a diagram that illustrates an example of an LCD display system having an application specific integrated circuit ("ASIC 411") with color shifting compensation for front and side viewing according to one embodiment of the present invention. Referring to FIG. 11, LCD 400 comprises a plurality of pixels (a pixel being represented by, e.g., P(i, j), i and j being positive integers), data drivers 402, scan drivers 404, and a timing controller 406, similar to the LCD panel shown in FIG. 4. One image is displayed in the LCD for each frame period. A frame period is divided into n subframes $SFP_1$ through $SFP_n$, n being a positive integer. The original gray scales of pixels P(i, j) are GR0(i, j). A lookup table LUT1 records the original gray scales (GR0) and the corresponding adjusted gray scales GR1. A lookup table LUT2 records the original gray scales (GR0) and corresponding adjusted gray scales GR2. A power supply 403 supplies power to data drivers 402 and scan drivers 404. Timing controller 406 in ASIC 401 outputs a data control signal to data drivers 402, which accordingly receive and process the pixel data from controller 406. ASIC 411 further includes a data selector 405, LUT 1 and LUT 2, an interface 408 provided between LUT 2 and a memory 409 (which is an EEPROM).

The above embodiments of display devices and methods consistent with the present invention for compensating color shifting between front and side views of images can advantageously minimize the effects of color shifting and optimize image quality of the display device. One embodiment is advantageously implemented in a multi-domain vertically aligned LCD. Furthermore, embodiments consistent with the present invention can be implemented in an LCD for all of its pixels, or specifically implemented to particular pixels, to reduce the adverse effects of color shifting.

Other embodiments of the present invention will be apparent to those skilled in the art from consideration of the specification and practice of the present invention disclosed herein. It is intended that the specification and examples be considered as exemplary only, with a true scope and spirit of the present invention being indicated by the following claims.

We claim:

1. A system comprising:

a display element having an original luminance value in a frame period corresponding to an input data between a minimum gray scale and a maximum gray scale;

an adjusted gray scale generator for receiving the input data and outputting a plurality of adjusted gray scale signals including a first adjusted gray scale signal and a second adjusted gray scale signal; and a driving unit for driving the display element according to the first adjusted gray scale signal in a first subframe period and driving the display element according to the second adjusted gray scale signal in a second subframe period to result in an adjusted luminance value of the display element, wherein the first subframe period and the second subframe period are within the frame period and the second subframe period follows the first subframe period;

wherein when the input data is between a first gray scale and a second gray scale, wherein the first gray scale and the second gray scale are predetermined values both higher than the minimum gray scale and lower than the maximum gray scale, the first adjusted gray scale signal is higher than the second adjusted gray scale signal and the first adjusted gray scale signal is substantially equal to a third gray scale and is lower than the maximum gray scale, wherein the third gray scale is lower than the second gray scale, and wherein when the input data is between the second gray scale and the maximum gray scale value, the first adjusted gray scale signal is equal to the second adjusted gray scale signal.

2. The system of claim 1 wherein the original luminance value and the adjusted luminance value of the display element when the display element is viewed from a front view point are generally the same.

3. The system of claim 1 wherein the original luminance value is corresponding to a gray scale of the display element in the frame period, the adjusted luminance value is corresponding to one of a plurality of adjusted gray scales of the display element in one of a plurality of subframe periods, and the gray scale is between two of the adjusted gray scales corresponding to two of the subframe periods within the frame period.

4. The system of claim 1 further comprising a lookup table storing the input data and the adjusted gray scale signals.

5. The system of claim 1 wherein the display element is a multi-domain vertically aligned liquid crystal pixel.

6. The system of claim 1 wherein when the input data is between 0 and the first gray scale, the first adjusted gray scale signal is higher than the second adjusted gray scale signal and approaches the third gray scale.

7. The system of claim 6 wherein the second adjusted gray scale signal is 0.

8. The system of claim 1 wherein when the input data is between the second gray scale and the maximum gray scale, the first adjusted gray scale signal is equal to the second adjusted gray scale signal.

9. A method for driving a display comprising:

obtaining an original luminance value in a frame period corresponding to an input data between a minimum gray scale and a maximum gray scale;

receiving the input data and outputting a plurality of adjusted gray scale signals including a first adjusted gray scale signal and a second adjusted gray scale signal; and driving a display element according to the first adjusted gray scale signal in a first subframe period and driving the display element according to the second adjusted gray scale signal in a second subframe period to result in an adjusted luminance value of the display element, wherein the first subframe period and the second subframe period are within the frame period and the second subframe period follows the first subframe period;

wherein when the input data is between a first gray scale and a second gray scale, wherein the first gray scale and the second gray scale are predetermined values both higher than the minimum gray scale and lower than the maximum gray scale, the first adjusted gray scale signal is higher than the second adjusted gray scale signal and the first adjusted gray scale signal is substantially equal to a third gray scale and is lower than the maximum gray scale, wherein the third gray scale is lower than the second gray scale, and wherein when the input data is between the second gray scale and the maximum gray scale value, the first adjusted gray scale signal is equal to the second adjusted gray scale signal.

10. The method of claim 9 wherein the original luminance value is corresponding to a gray scale of the display element in the frame period, the adjusted luminance value is corresponding to one of a plurality of adjusted gray scales of the display element in one of the plurality of subframe periods, the gray scale is between two of the adjusted gray scales corresponding to two of the subframe periods within the frame period.

11. The method of claim 9 wherein when the input data is between 0 and the first gray scale, the first adjusted gray scale signal is higher than the second adjusted gray scale signal and approaches the third gray scale.

12. The method of claim 11 wherein the second adjusted gray scale signal is 0.

13. The method of claim 9 wherein when the input data is between the second gray scale and the maximum gray scale, the first adjusted gray scale signal is equal to the second adjusted gray scale signal.

14. A display device comprising:

a plurality of first pixels;

a plurality of second pixels;

a circuit for receiving an original signal corresponding to a first intensity value between a minimum gray scale and a maximum gray scale for a first pixel at a first frequency in a frame period consisting of a plurality of subframe periods;

a converter for converting the original signal into two adjusted signals, including a first adjusted gray scale signal and a second adjusted gray scale signal, corresponding to a second intensity value and a third intensity value, respectively, at a second frequency wherein the second frequency is larger than the first frequency, wherein the first intensity value is between the second and the third intensity values; and a memory for storing and outputting the two adjusted signals to the first pixel;

wherein each of the first pixels and the second pixels has a pair of first color sub-pixels, a pair of second color sub-pixels, and a pair of third color sub-pixels, and the first pixels and the second pixels are interlaced in an alternating fashion horizontally and vertically to compose the display device;

wherein the first color sub-pixels, the second color sub-pixels, and the third color sub-pixels in each of the first pixels are arranged in a first shape, the first color sub-pixels, the second color sub-pixels, and the third color sub-pixels in each of the second pixels are arranged in a second shape, wherein the first shape and the second shape are symmetrical to each other;

wherein each pair of the first color sub-pixels are arranged along a first diagonal line, and each pair of the second color sub-pixels are arranged along a second diagonal line, wherein the first diagonal line is substantially perpendicular to the second diagonal line, wherein one of the first color sub-pixels in each first pixel is directly adjacent to one of the first color sub-pixels in one of the second pixels adjacent to the first pixel, and one of the second color sub-pixels in the first pixel is directly adjacent to one of the second color sub-pixels in the other one of the second pixels adjacent to the first pixel, and wherein when the original signal is between a first gray scale and a second gray scale, wherein the first gray scale and the second gray scale are predetermined values both higher than the minimum gray scale and lower than the maximum gray scale, the first adjusted gray scale signal is higher than the second adjusted gray scale signal and the first adjusted gray scale signal is substantially equal to a third gray scale and is lower than the maximum gray scale, wherein the third gray scale is lower than the second gray scale, and wherein when the input data is between the second gray scale and the maximum gray scale value, the first adjusted gray scale signal is equal to the second adjusted gray scale signal.

15. The display device of claim 14, wherein the first color is red, the second color is blue, and the third color is green.

16. A display device comprising:

a plurality of first pixels;

a plurality of second pixels;

a circuit for receiving an original signal corresponding to a first intensity value between a minimum gray scale and a maximum gray scale for a first pixel at a first frequency in a frame period consisting of a plurality of subframe periods;

a converter for converting the original signal into two adjusted signals, including a first adjusted gray scale signal and a second adjusted gray scale signal, corresponding to a second intensity value and a third intensity value, respectively, at a second frequency wherein the second frequency is larger than the first frequency, wherein the first intensity value is between the second and the third intensity values; and a memory for storing and outputting the two adjusted signals to the first pixel, wherein each of the first pixels and the second pixels has a pair of first color sub-pixels, a pair of second color sub-pixels, and a pair of third color sub-pixels, and the first pixels and the second pixels are interlaced in an alternating fashion horizontally and vertically to compose the display device, wherein the first color sub-pixels, the second color sub-pixels, and the third color sub-pixels in each of the first pixels are arranged in a first shape, the first color sub-pixels, the second color sub-pixels, and the third color sub-pixels in each of the second pixels are arranged in a second shape, wherein the first shape and the second shape are symmetrical to each other, wherein each pair of the first color sub-pixels are arranged along a first diagonal line, and each pair of the second color sub-pixels are arranged along a second diagonal line, wherein the first diagonal line is substantially perpendicular to the second diagonal line, wherein when the original signal is between a first gray scale and a second gray scale, wherein the first gray scale and the second gray scale are predetermined values both higher than the minimum gray scale and lower than the maximum gray scale, the first adjusted gray scale signal is higher than the second adjusted gray scale signal and the first adjusted gray scale signal is substantially equal to a third gray scale and is lower than the maximum gray scale, wherein the third gray scale is lower than the second gray scale, and wherein when the input data is between the second gray scale and the maximum gray scale value, the first adjusted gray scale signal is equal to the second adjusted gray scale signal.

17. The display device of claim 16 wherein the first color is red, the second color is blue, and the third color is green.

* * * * *